US007370817B2

(12) United States Patent
Tilton et al.

(10) Patent No.: US 7,370,817 B2
(45) Date of Patent: May 13, 2008

(54) ACTUATED ATOMIZER

(75) Inventors: Charles Tilton, Colton, WA (US); Jeff Weiler, Liberty Lake, WA (US); Randall Palmer, Kendrick, ID (US); Philip Appel, Liberty Lake, WA (US)

(73) Assignee: Isothermal Systems Research Inc., Liberty Lake, WA (US)

( * ) Notice: Subject to any disclaimer, the term of this patent is extended or adjusted under 35 U.S.C. 154(b) by 0 days.

(21) Appl. No.: 10/281,391

(22) Filed: Oct. 24, 2002

(65) Prior Publication Data

US 2004/0089743 A1 May 13, 2004

(51) Int. Cl.
*F02M 51/00* (2006.01)

(52) U.S. Cl. ..... 239/585.5; 239/132; 239/132.5; 239/472; 239/473; 239/492; 239/533.12; 239/585.1; 62/64

(58) Field of Classification Search ..... 239/491, 239/492, 496, 472, 473, 482, 584, 585.1, 239/585.4, 585.5, 533.11, 533.12, 475, 128, 239/132, 132.5, 132.3; 62/64
See application file for complete search history.

(56) References Cited

U.S. PATENT DOCUMENTS 1,481,597 A * 1/1924 Forster ..... 239/482
4,621,771 A * 11/1986 Chiba et al. ..... 239/585.4
4,877,187 A * 10/1989 Daly ..... 239/491
5,108,037 A * 4/1992 Okamoto et al. ..... 239/473
5,570,841 A * 11/1996 Pace et al. ..... 239/496
5,997,530 A * 12/1999 Nelson et al. ..... 606/9
6,205,799 B1 3/2001 Patel et al.
6,257,496 B1 * 7/2001 Wyant ..... 239/492
6,349,554 B2 2/2002 Patel et al.
6,457,321 B1 10/2002 Patel et al.

(Continued)

OTHER PUBLICATIONS

Tilton, Charles. Spray Quench System for Directional Solidification Furnaces, Isothermal Systems Research, Inc. (ISR), Clarkston, WA. Sep. 11, 1998. (1 page).

*Primary Examiner*—Steven J. Ganey
(74) *Attorney, Agent, or Firm*—Wells St. John P.S.

(57) ABSTRACT

An actuated atomizer is adapted for spray cooling or other applications wherein a well-developed, homogeneous and generally conical spray mist is required. The actuated atomizer includes an outer shell formed by an inner ring; an outer ring; an actuator insert and a cap. A nozzle framework is positioned within the actuator insert. A base of the nozzle framework defines swirl inlets, a swirl chamber and a swirl chamber. A nozzle insert defines a center inlet and feed ports. A spool is positioned within the coil housing, and carries the coil windings having a number of turns calculated to result in a magnetic field of sufficient strength to overcome the bias of the spring. A plunger moves in response to the magnetic field of the windings. A stop prevents the pintle from being withdrawn excessively. A pintle, positioned by the plunger, moves between first and second positions. In the first position, the head of the pintle blocks the discharge passage of the nozzle framework, thereby preventing the atomizer from discharging fluid. In the second position, the pintle is withdrawn from the swirl chamber, allowing the atomizer to release atomized fluid. A spring biases the pintle to block the discharge passage. The strength of the spring is overcome, however, by the magnetic field created by the windings positioned on the spool, which withdraws the plunger into the spool and further compresses the spring.

15 Claims, 7 Drawing Sheets

U.S. PATENT DOCUMENTS 6,484,521 B2 11/2002 Patel et al.
6,550,263 B2 4/2003 Patel et al.
6,595,014 B2 7/2003 Malone et al.
6,604,370 B2 8/2003 Bash et al.
6,644,058 B2 11/2003 Bash et al.
6,708,515 B2 3/2004 Malone et al.

* cited by examiner

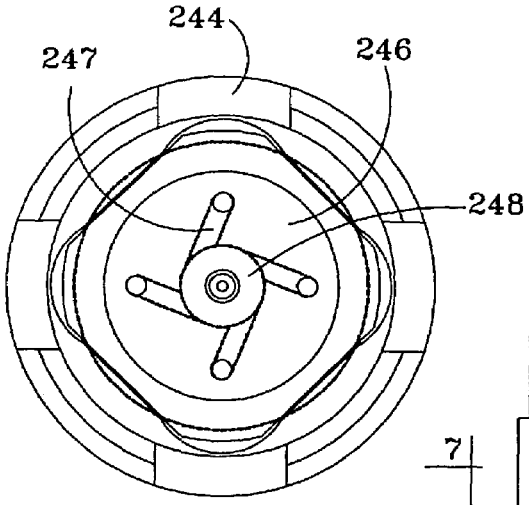
FIG. 5
FIG. 6
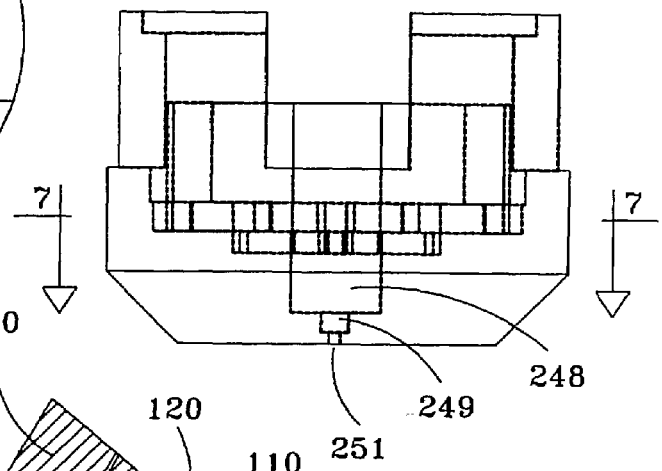
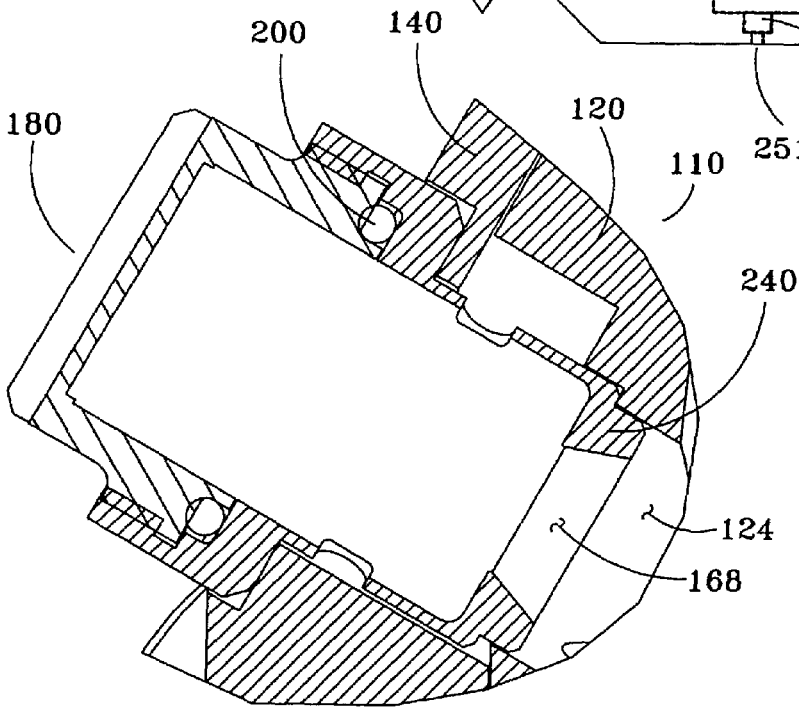
FIG. 8

ACTUATED ATOMIZER

GOVERNMENT CONTRACT RIGHTS

This invention was made in connection with U.S. NASA SBIR Contract # NAS8-40644.

CROSS REFERENCE TO RELATED APPLICATION

There are no applications related to this application filed in this or any foreign country.

TECHNICAL FIELD

This invention generally pertains to an actuated atomizer, said atomizer having, without limitation, particular applications in spray cooling and fuel injection devices.

BACKGROUND OF THE INVENTION

The atomization of fluid into droplets is known, as are several variations of spray devices that support such functionality. Applications for such an apparatus include the spray cooling of electronic components with non-conducting fluid and use in internal combustion engines.

It is the nature of atomizers that their characteristics, including spray droplet density and the configuration of the spray cone which results, is dependent on the geometry of the spray nozzle and also the pressure and nature of the fluid delivered to the nozzle. The geometry of the spray nozzle is linked to the pressure of the fluid delivered; i.e. any given spray nozzle is only operable within a range of supply fluid pressures. When fluid is delivered within the intended range of pressures, the droplet size and distribution is optimized. The correct number of droplets, in the correct size, distributed in the correct manner, result in optimum spraying for efficient cooling.

It is therefore a problem that any spray nozzle is adapted for release of fluid at only a narrow range of rates. Where fluid is delivered at too low or too high a pressure, the droplet size and distribution are flawed, resulting in inefficient spraying.

In liquid cooling applications, it is sometimes the case that the energy output of the heat load to be cooled is less than the heat removal ability of the associated nozzle, even when the fluid pressure is reduced to the degree possible within the tolerance range. As a result, excessive fluid is used in the cooling process.

Alternatively, it may be the case that the fluid pressure delivered to a first atomizer in a common manifold or plenum cannot be lowered, due to the greater pressure requirements of a second atomizer. Consequently, the fluid is delivered to a first atomizer at excessive pressure, resulting in fluid waste.

For the foregoing reasons, there is a need for an atomizer that can be operated in a manner that allows a more precise control over the volume of fluid flow and the resulting level of heat removal. The atomizer is preferably able to remove heat loads that are smaller than that which would be removed by an atomizer of similar spray capacity operating at minimal fluid pressure consistent with the atomizer's design. The atomizer is preferably adjustable in a manner that allows selection of the overall fluid flow given any pressure. The atomizer is preferably adjustable in a manner that compensates for changing fluid pressure or changes in the level of the heat load to be removed.

BRIEF DESCRIPTION OF THE DRAWINGS

Preferred embodiments of the invention are described below with reference to the following accompanying drawings.

FIG. 5 is a view similar to that of FIG. 3, additionally showing the tangentially oriented swirl passages that deliver fluid from the feed ports to the swirl chamber.

FIG. 6 is a side orthographic view similar to that of FIG. 4, taken along the 6-6 lines of FIG. 7, additionally showing the swirl inlet and two of the four feed ports, the swirl chamber, discharge passage and discharge aperture.

FIG. 8 is a cross-sectional view of an outer enclosure suitable for containment of the actuated atomizer insert of FIG. 1.

DETAILED DESCRIPTION OF THE PREFERRED EMBODIMENTS

Figure 1:
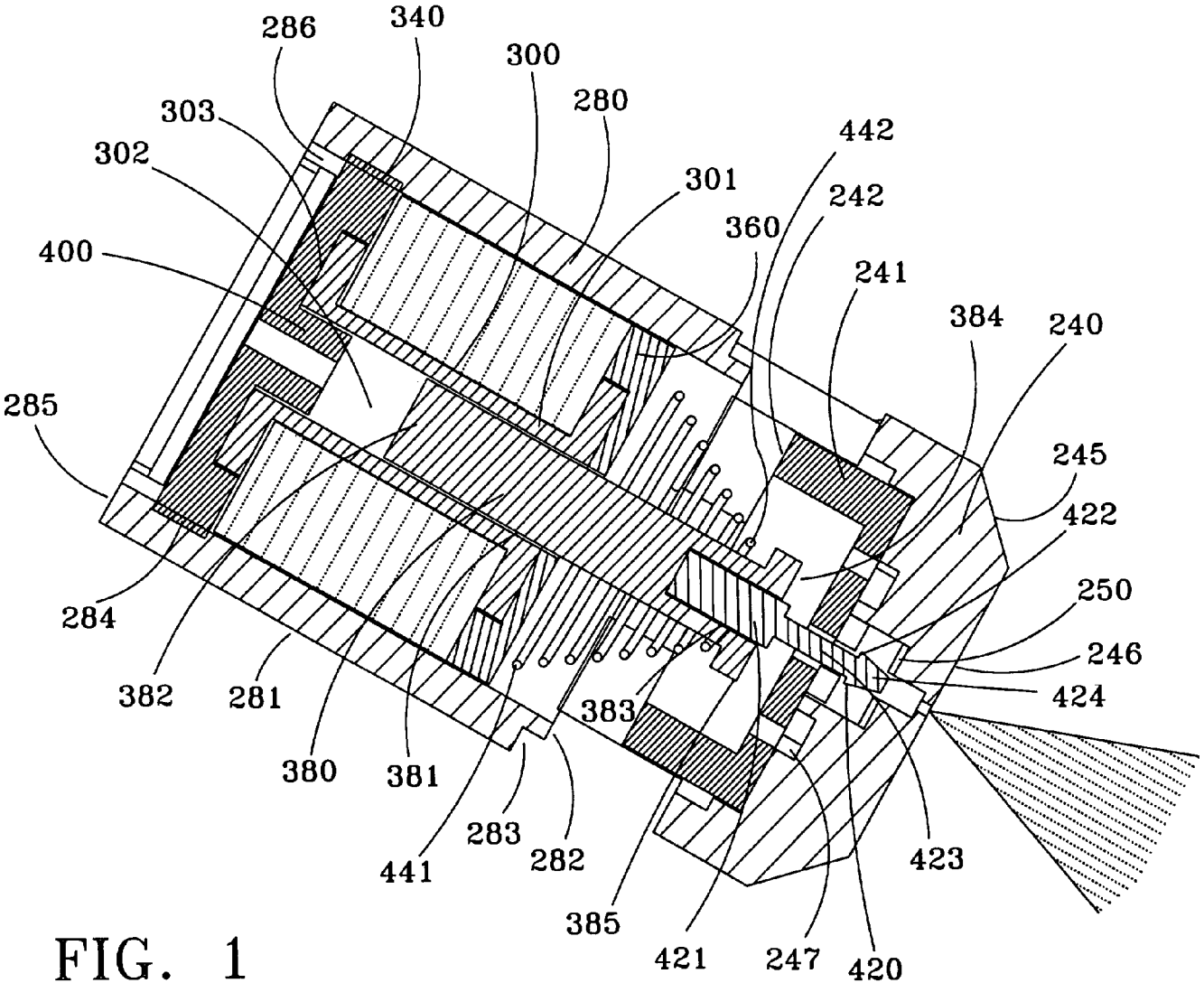
FIG. 1 is a cross-sectional view of an actuated atomizer insert.
Figure 2:
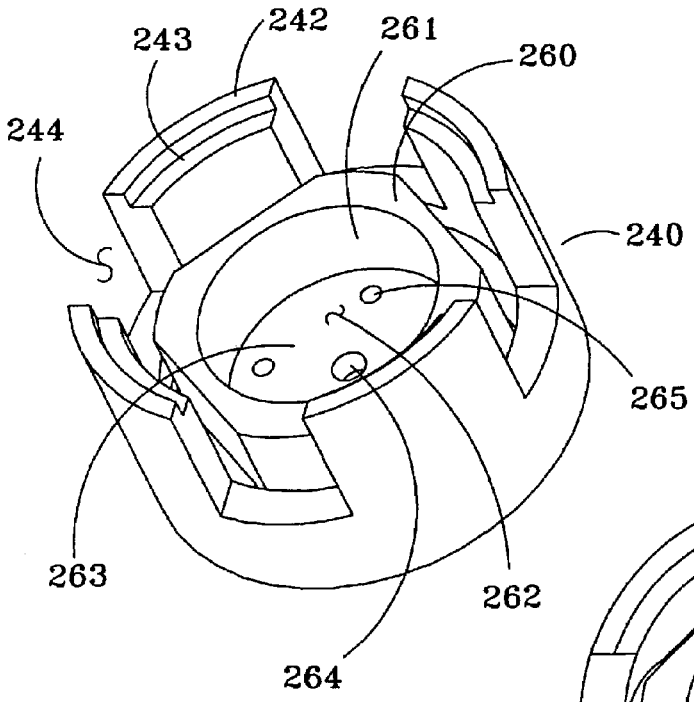
FIG. 2 is perspective view of the nozzle housing and nozzle insert seen in FIG. 1, enlarged for clarity.
Figure 3:
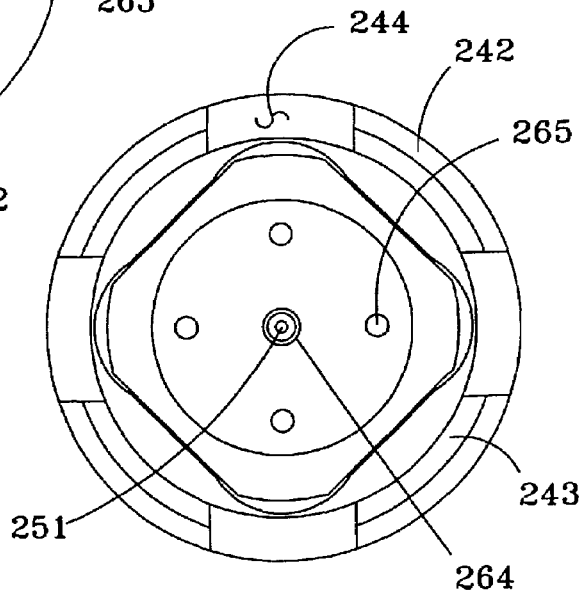
FIG. 3 is a plan orthographic view of the nozzle housing and nozzle insert of FIG. 2, illustrating four feed ports and a center inlet defined in a circular base.
Figure 4:
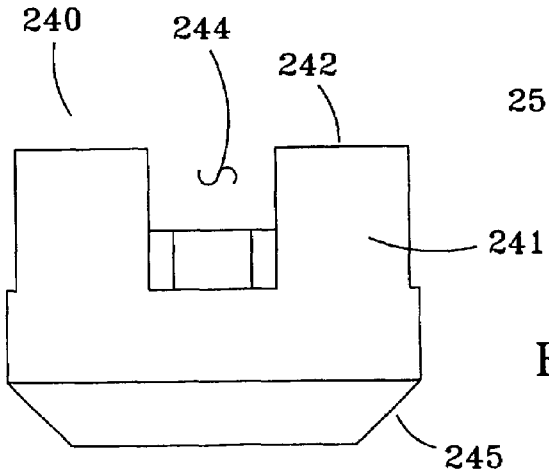
FIG. 4 is a side orthographic view of the nozzle housing and nozzle insert of FIG. 3.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The present invention is directed to an apparatus that satisfies the above needs. A novel actuated atomizer for spray cooling is disclosed with an aspect which is able to remove heat loads which are smaller than that which would be removed by an atomizer of similar capacity operating at minimal fluid pressure consistent with the atomizer's design; with another aspect that is adjustable in a manner which allows selection of the overall fluid flow given any pressure; and with another aspect which is adjustable in a manner which compensates for changing fluid pressure or changes in the level of the heat load to be removed.

The actuated atomizer 100 for spray cooling of the present invention provides multiple different structures, such as are described below.

An example of a spray cooling system into which an embodiment of the invention may be incorporated is that disclosed in U.S. Pat. No. 5,220,804 for a "High heat Flux Evaporative Spray Cooling" system, which is hereby incorporated by this reference.

An outer enclosure defines an interior compartment within which most of the other components of the actuated atomizer are contained. The outer enclosure includes an inner ring 120, an outer ring 140, an actuator insert 160 and a cap 180. A fluid channel 122, defined between the inner ring and actuator insert, provides fluid to the atomizer. The cap 180 is attached into the actuator insert, and defines an interior compartment 169 within which the below components are carried.

An upper O-ring 200 forms a fluid tight seal between the cap and the actuator insert. A lower O-ring 220 forms a fluid tight seal between the actuator insert and the nozzle housing.

A nozzle housing 240 is carried within the actuator insert 160, adjacent to a spray passage 168 defined within the actuator insert, through which the spray is discharged. An inside surface of the circular base 246 of the nozzle housing defines four swirl inlets 247 arrayed in 90 degree intervals about a first end of a swirl chamber 248. A discharge aperture is defined at the second end of the swirl passage, allowing a spray mist to be discharged.

A nozzle insert 260 is carried adjacent to the circular base of the nozzle housing. A center inlet allows passage through the nozzle insert, and is centrally located. Four feed ports also allow passage through the nozzle insert, and are distributed about the center inlet at 90-degree intervals. The center inlet is aligned with the swirl chamber of the nozzle housing, and each feed port is aligned with a swirl inlet defined in the circular base of the nozzle housing.

A coil housing 280 is carried within the interior compartment defined within the actuator insert and cap. A groove defined in a lower rim of the coil housing is mated to a groove defined in an upper rim of the nozzle housing.

A spool 300 is carried within the coil housing. The spool includes a cylindrical body having upper and lower end plates that retain the windings 320. The end plates are formed of radially extending spokes between which are defined notches. The notches allow fluid to circulate against the windings, to thereby cool the coil and prevent over heating.

A spool cap 340 and a spool base 360 secure the spool and windings within the coil housing.

A plunger 380 moves in response to the magnetic field of the windings. The plunger includes a cylindrical body that travels within a channel defined within the cylindrical body of the spool. Three spokes carried by a lower end of the plunger provide a location on which the spring may press, biasing the plunger toward the discharge aperture.

A stop 400 prevents the plunger from being withdrawn excessively into the spool.

A pintle 420, carried by the plunger 380, moves between first position and second positions. In the first position, the head of the pintle blocks the discharge passage of the nozzle housing 240, thereby preventing the atomizer from discharging fluid. In the second position, the pintle is withdrawn from the swirl passage, where it meters the discharge aperture, and allows the atomizer to release atomized fluid.

A spring 440 pushes on the spokes of the plunger, urging the pintle to block the swirl passage, and allowing the spring to decompress slightly. The strength of the spring is overcome, however, by the magnetic field created by the windings carried on the spool. When the plunger is withdrawn into the spool, the spring is compressed.

It is therefore a feature of embodiments of the present invention to provide a novel actuated atomizer that results in a well-developed, uniform, full cone-shaped spray, which may be rapidly turned on and off to result in the desired discharge rate of spray fluid in a given application.

Another advantage of the present invention is to provide a novel actuated atomizer wherein fluid flowing past the windings removes heat from the coil, thereby preventing overheating.

A still further advantage of the present invention is to provide a novel actuated atomizer wherein the benefits of an atomizer with a plurality of feed ports and associated swirl inlets, a swirl chamber, a swirl passage and a discharge aperture are combined with a pintle capable of stopping the fluid flow.

These features and others will be advantageous to other applications, such as for fuel injection systems for internal combustion engines, such as in vehicles.

Referring in particular to FIG. 1, an actuated atomizer 100 for spray cooling or other applications, such a fuel carburetion, wherein a well developed, homogeneous and generally conical spray mist is required. The actuated atomizer is particularly indicated for use in applications wherein precise control of the duty cycle, i.e. the rate of fluid discharge, is required. The required control is obtained by regulation of structures that alternately turn the actuated atomizer on and off. This is particularly desirable for atomizing coolant or other fluid at the most efficient rate required for the application.

The actuated atomizer 100 of FIG. 1 includes an outer enclosure 110 formed by an inner ring 120; an outer ring 140; an actuator insert 160 and a cap 180. A nozzle housing 240 is carried within the actuator insert. A circular base 246 of the nozzle housing defines swirl inlets, a swirl chamber and a discharge passage. A nozzle insert 260 defines a center inlet and feed ports that supply the swirl inlets. A spool 300 is carried within the coil housing, and carries the coil windings 320 having a number of turns calculated to result in a magnetic field of sufficient strength to overcome the bias of the spring 440. A plunger 380 moves in response to the magnetic field of the windings. A stop 400 prevents the plunger from being withdrawn excessively into the spool. A pintle 420, carried by the plunger, moves between first and second positions. In the first position, the head of the pintle blocks the swirl passage of the nozzle housing, thereby preventing the atomizer from discharging fluid. In the second position, the pintle is withdrawn from the swirl passage, allowing the atomizer to release atomized fluid. A spring 440 biases the pintle to block the swirl passage. The strength of the spring is overcome, however, when the magnetic field is created by the windings carried on the spool. When the plunger is withdrawn into the spool, the spring is compressed.

An outer enclosure 110 defines an interior compartment within which the other components of the actuated atomizer are contained. In the application illustrated in FIG. 8, the outer shell includes an inner ring 120; an outer ring 140; an actuator insert 160 and a cap 180. The nature, including dimensions and shape, of the outer enclosure is dependent on the application or use, and could therefore vary considerably.

Figure 9:
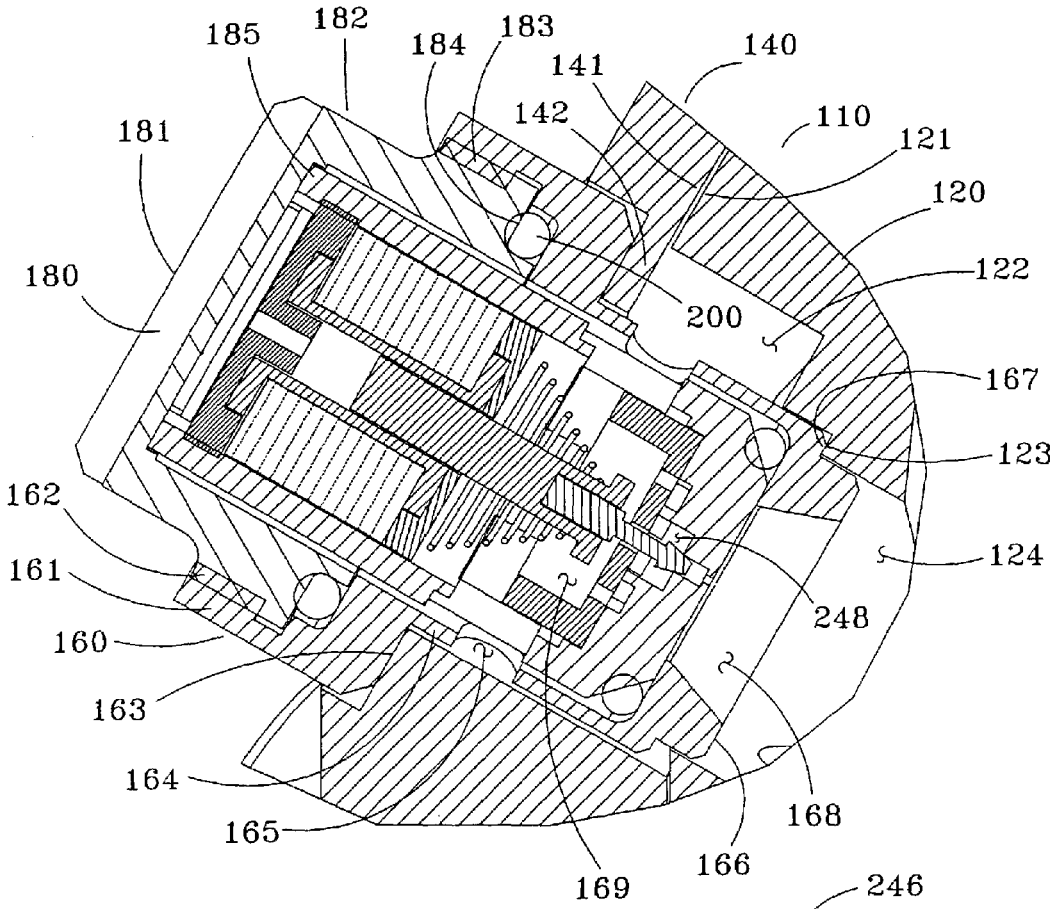
FIG. 9 is a view of the insert of FIG. 1 installed in the enclosure of FIG. 8.
Figure 7:
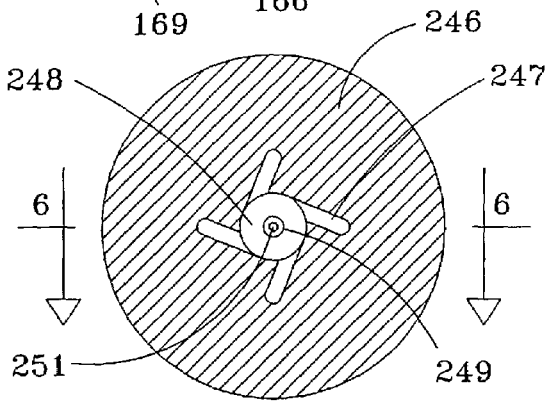
FIG. 7 is a view similar to that of FIG. 5, taken along the 7-7 lines of FIG. 6, showing the relationship of the four feed ports, four swirl passages and swirl chamber.
Figure 10:
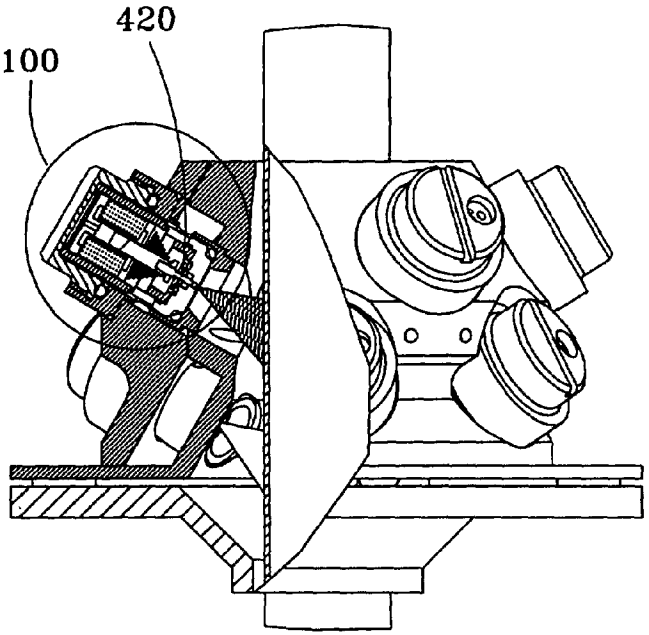
FIG. 10 is a complex enclosure containing a number of inserts.
Figure 11:
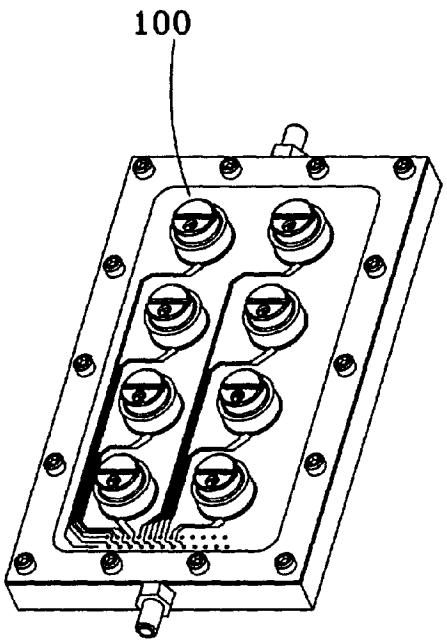
FIG. 11 is an isometric view of a spray plate containing a plurality of actuated atomizers.
Figure 12:
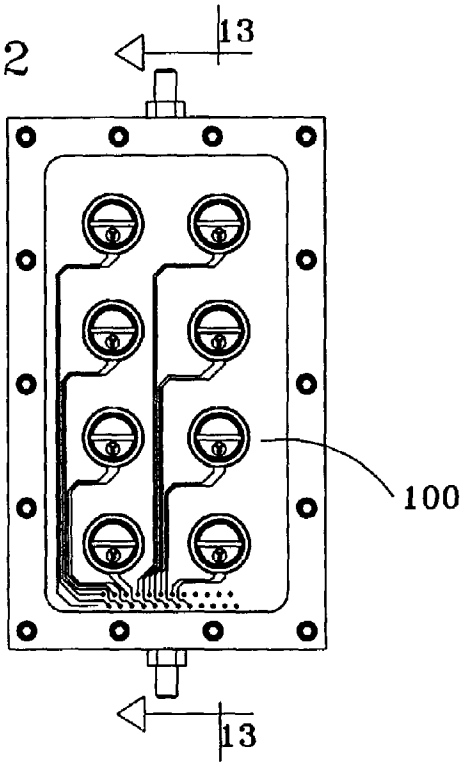
FIG. 12 is a plan orthographic view of the spray plate of FIG. 11.
Figure 14:
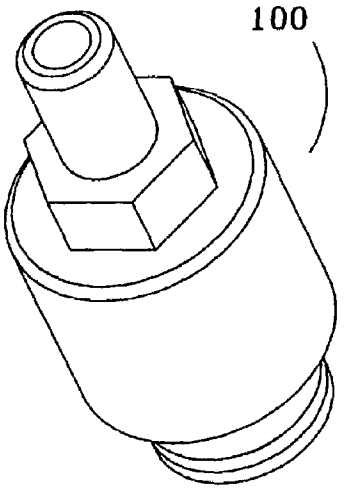
FIG. 14 is an isometric view of an enclosure for a second version of an actuated according to the instant invention.
Figure 13:
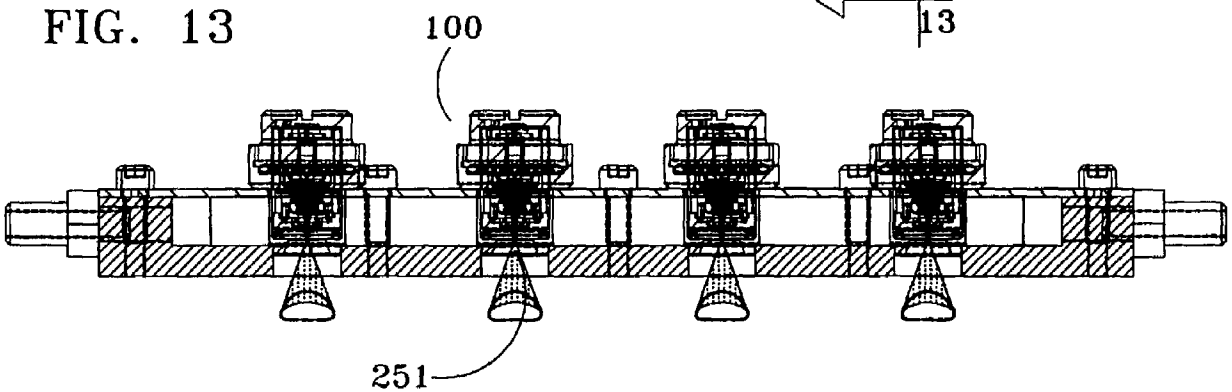
FIG. 13 is an enlarged cross-sectional view of the spray plate of FIG. 12, taken along the 13-13 lines.
Figure 15:
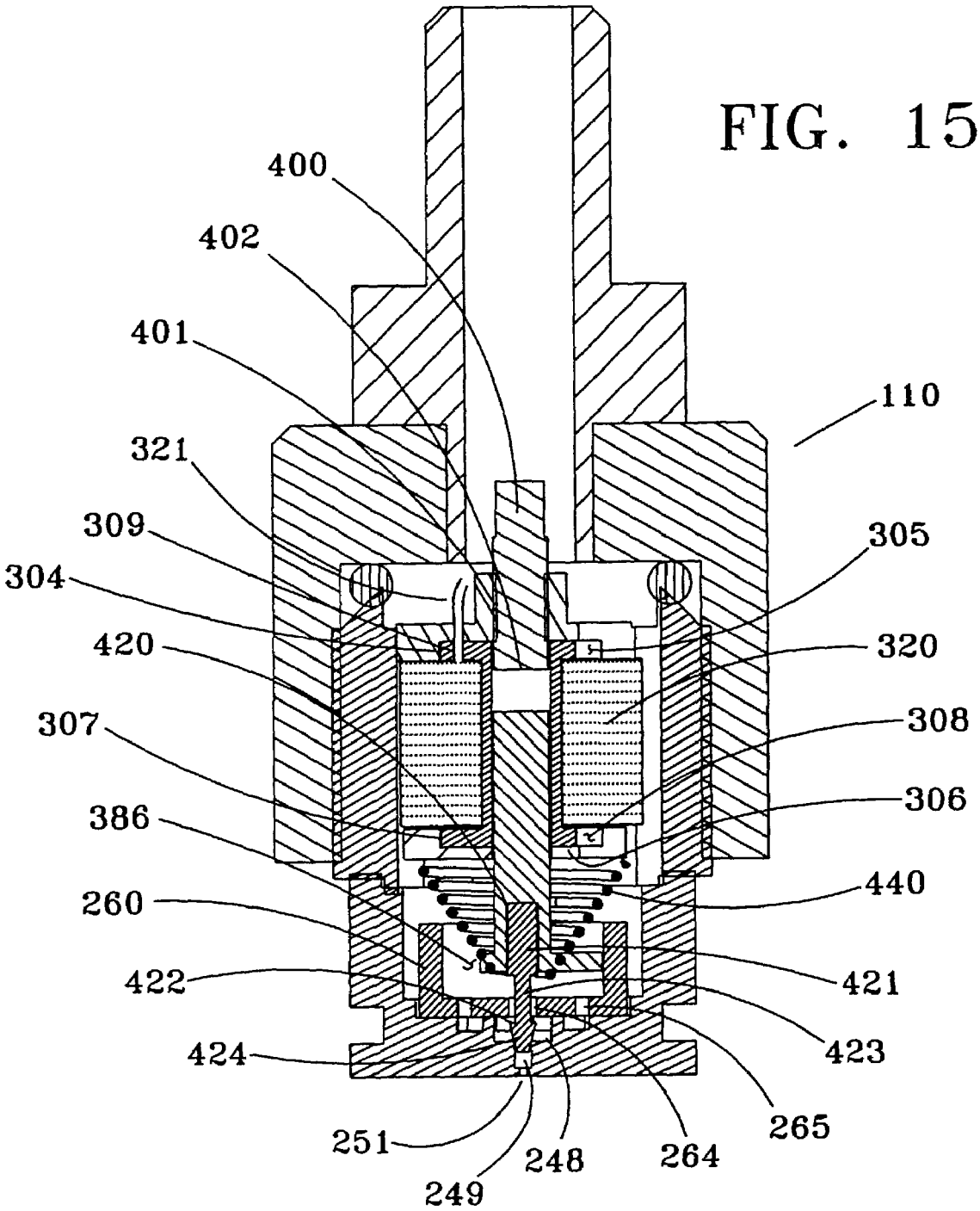
FIG. 15 is a cross-sectional view of the actuated atomizer of FIG. 14.

Referring to FIGS. 8 and 9, it can be seen that the inner ring 120 is carried by a lower portion of the actuator insert. An outer edge 121 of the inner ring mates with the outer ring 140, resulting in a fluid-tight seal. A shoulder 123 mates with an inner shoulder 167 of the actuator insert 160. A fluid channel 122, defined within a region bounded by the inner and outer rings and the actuator insert, provides fluid to the atomizer. A spray opening 124, defined in the inner ring, allows discharge from the discharge aperture 251 of the nozzle housing 240 to pass without obstruction.

As seen in FIG. 8, an outer ring 140 is carried between the inner ring 120 and the actuator insert 160. An inner edge 141 of the outer ring mates against the outer edge 121 of the inner ring 120.

As seen in FIG. 9, an actuator insert 160 is adjacent to the inner and outer rings, and is threaded to the cap 180. The actuator insert includes connected concentric cylindrical inner and outer bodies, having lesser and greater diameter, respectively. Together, actuator insert and the cap define an interior compartment 169, within which an atomizer is carried.

The outer body 161 has threads 162 defined on an inner surface. The internal threads allow connection to the cap 180, thereby defining an interior compartment 169 within which many of the below components are contained. An outer shoulder 163, defining a transition between the outer body and inner body, supports the inner flange 142 of the outer ring 140.

As seen in the cross-sectional view of FIG. 9, the inner body 164 has a smaller diameter than the outer body. The inner body defines at least one hole 165 to allow fluid passage from the fluid channel 122 into the internal cavity 262 of the nozzle insert 260. An end face 166 portion of the inner body 164, defines a spray passage 168 that allows spray discharged from the discharge aperture 251 to pass. An inner shoulder 167 formed about a peripheral surface of the end plate is seated on a similar shoulder 123 defined in the inner ring.

A cap 180 is threaded onto the actuator insert, defining a further interior compartment 169. A top 181 of the cap is adjacent to a cylindrical sidewall 182 having external threads 183 which mate with the internal threads 162 of the actuator insert 160. A notch 184 defines a space for an upper O-ring 200, which forms a seal between the actuator insert 160 and the cap 180.

A nozzle housing 240 is carried within the actuator insert or may be formed as part of the actuator insert. As in FIG. 9, in an embodiment wherein the nozzle housing is separate from the actuator insert, the nozzle housing is adjacent to a spray passage 168 defined within the actuator insert, through which the spray is discharged.

The nozzle housing has a cylindrical outer wall having a diameter of incrementally less than the inside diameter of the actuator insert. The cylindrical wall is formed of four sections 241 separated by slots 244. The sections 241 each have an upper rim 242 having a first groove 243 to mate with a similar rim 282 and groove 283 of the coil housing 280. The slots 244 allow fluid carried by the fluid channel 122 to pass into the internal cavity 262 of the nozzle insert 260.

As seen in FIG. 9, a lower O-ring 220 forms a fluid tight seal between the actuator insert and the nozzle housing. An O-ring notch 245 between the nozzle housing and an inside surface of the end face 166 of the actuator insert results in a space in which the O-ring may be carried.

An inside surface of the circular base 246 of the nozzle housing defines four swirl inlets 247 arrayed in 90 degree intervals about a swirl chamber 248. This geometric configuration allows fluid from each swirl inlet 247 to travel into an upstream end of the swirl chamber. The fluid enters the swirl chamber at an orientation that is tangential to the axis of the cylindrical swirl chamber, causing the fluid within the swirl chamber to rotate.

A downstream end of the swirl chamber is in communication with an upstream end of the discharge passage 249. The discharge passage is generally cylindrical, with a diameter less than the diameter of the swirl chamber. An upstream perimeter of the discharge passage supports a valve seat insert 250, which contacts the head of the pintle when the pintle is extended to prevent fluid discharge.

A discharge aperture 251 is defined at the downstream end of the discharge passage, allowing a spray mist to be discharged.

As seen in FIG. 1, a nozzle insert 260 is adjacent to the nozzle housing 240. The nozzle insert aids in the manufacturing process, by allowing the atomizer to be more conveniently made from layers.

A circular base 263 of the nozzle insert 260 is carried against the circular base 246 of the nozzle housing 240. A cylindrical sidewall 261 of the nozzle insert is carried against the cylindrical sidewall 241 of the nozzle housing. An internal cavity 262, defined generally between the sidewall and circular base, contains fluid during operation.

A center inlet 264 is centrally located within the nozzle insert 260, and allows fluid to pass through the nozzle insert and around the neck of the pintle. The center inlet is aligned with the swirl chamber of the nozzle housing, allowing fluid to pass through the nozzle insert and into the swirl chamber.

Four feed ports 265 also allow fluid to pass during operation through the nozzle insert and into the swirl inlets 247, defined in the nozzle housing. Each feed port is aligned with a portion of the associated swirl inlet that is most distant from the swirl chamber 248. As a result, the four feed ports are distributed about the center inlet at 90-degree intervals.

A coil housing 280 is carried within the interior compartment defined within the actuator insert 160 and cap 180. The coil housing encloses the spool 300 and the windings 320 carried by the spool.

The coil housing is formed by hollow cylinder sidewall 281, having an outside diameter incrementally less than the inside diameter of portions of the actuator insert 160 and cap 180. A lower rim 282 of the sidewall defines a second groove 283 which is sized to mate with the first groove 243 in the upper rim 242 of each of the cylindrical sidewall sections 241 of the nozzle housing 240.

Internal threads 284 are defined on the end of the coil housing nearest the cap 180, and are sized to mate with the external threads 345 on the spool cap 340. With the spool cap attached to the coil housing, the spool and windings are secured within the sidewall of the coil housing.

As seen in FIG. 9, an upper rim 285 of the coil housing defines one or more alignment lobes 286 that mate to a corresponding recess 185 in the cap 180.

A spool 300 is carried within the coil housing 280. The spool includes a cylindrical body 301 having upper and lower end plates 303, 306 which retain the electrical wire windings 320. The end plates are formed of radially extending upper and lower spokes 304, 307 between which are separated by upper and lower notches 305, 308. The notches between the spokes allow fluid to circulate against the windings, and to thereby cool the coil and prevent over heating.

An electrical coil of windings 320 are carried on the spool, having a number of turns calculated to result in a magnetic field of sufficient strength to move the plunger and overcome the bias of the spring 440. A wiring hole 309 defined in one of the upper spokes 304 allows two wire leads 321 which power the coil to pass.

Within the cylindrical body 301 of the spool, a plunger travel path 302 is defined along an axial orientation. The plunger travel path allows the plunger to be moved between first and second positions in response to the magnetic field that is generated by the coil.

A spool cap 340 and a spool base 360 secure the spool and windings within the coil housing.

A plunger 380 moves in response to the magnetic field of the windings. The plunger includes a cylindrical body 381, made at least partly of iron, which travels within a plunger travel path 302 defined within the cylindrical body of the spool.

A top surface 382 on a first end of the body 381 contacts the stop 400, which prevents excessive movement of the plunger in response to the magnetic field. A lower axial channel 383 defined in the second end of the body supports the pintle 420.

An end plate 384, carried by the second end of the plunger, is in contact with the inner end 442 of the spring 440. In one embodiment of the invention, the end plate is formed by three spokes 385 separated by spaces 386. The spokes provide a surface that is in contact with the spring 440. The spaces 386 between the spokes allow free movement of the fluid within the internal cavity 262 of the nozzle insert 260 and the center inlet 264 and feed ports 265.

A stop 400 prevents the plunger from being withdrawn excessively into the spool, and strengthens the magnetic field's attraction to the plunger. The stop provides external threads 401 which engage the spool cap. By adjusting the degree to which the stop is advanced on the threads, the movement of the plunger into the travel path 302 can be precisely controlled. When the plunger is withdrawn fully into the plunger travel path, the top surface 382 of the plunger will contact the lower surface 402 of the stop.

A pintle 420, carried by the plunger, moves between first and second positions. In the first position, the head 424 of the pintle is seated against the valve seat insert 250, and blocks the discharge passage 249 defined in the circular base 246 of the nozzle housing 240. It should be noted that while the base is shown as circular, this invention is not limited to any particular shape or configuration. In this position, fluid is prevented from exiting the discharge aperture 251 of the atomizer, as seen in FIG. 9.

In the second position, the pintle is withdrawn from the swirl passage, allowing the atomizer to release atomized fluid through the discharge aperture, as seen in FIG. 1.

An upper cylinder 421 of the pintle is carried by the lower axial channel 383 of the plunger, typically by a glued connection. Alternatively, a threaded fastening connection may be used which allows adjustment of the degree to which the upper cylinder is inserted into the lower axial channel.

A shoulder 422, adjacent to the head 424 which meters the fluid flow, is supported by a first end of a neck 423. A second end of the neck is attached to the upper cylinder 421.

A spring 440 pushes on the spokes 385 of the plunger 380, urging the pintle 420 to block the swirl passage. When the head 424 of the pintle 420 is inserted into the discharge passage 249, the spring is in its more relaxed state. This prevents spray discharge, as seen in FIG. 9. The strength of the spring is overcome, as seen in FIG. 1, by the magnetic field created by the windings carried on the spool, and when the plunger is withdrawn into the spool, the spring is compressed.

Referring to FIG. 1, a radially outer turn of the spring 441 is carried by the spool base 360, while a radially inner turn 442 of the spring is carried by the end plate 384 of the plunger 380.

It will be appreciated by those of ordinary skill of the art that automotive or vehicular fuel injections systems are well known and utilize many different kinds and types of fuel injection devices and control systems, and they will not therefore be discussed in any further detail. It will further be appreciated by those of ordinary skill in the art that the invention disclosed herein, or aspects of it, may be incorporated without undue experimentation, into said fuel injection systems for an improved actuated atomizer.

The previously described versions of the present invention have many advantages, including a primary advantage of providing a novel actuated atomizer wherein the benefits of an atomizer that results in a well-developed, uniform, full cone-shaped spray, which may be rapidly turned on and off to result in the desired rate of delivery of spray fluid in a given application.

Another advantage of the present invention is to provide a novel actuated atomizer wherein fluid flowing past the windings removes heat from the coil, thereby preventing overheating.

A still further advantage of the present invention is to provide a novel actuated atomizer with a plurality of feed ports and associated swirl inlets, a swirl chamber, a swirl passage and a discharge aperture are combined with a pintle capable of stopping the fluid flow.

Although the present invention has been described in considerable detail and with reference to certain preferred versions, other versions are possible. For example, while a preferred version of the actuated atomizer has been disclosed, it is clear that other variation of the previously disclosed concepts would result in structures consistent with the teachings herein presented. Therefore, the spirit and scope of the appended claims should not be limited to the description of the preferred versions disclosed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. An actuated atomizer, comprising:

an outer enclosure, comprising:

an actuator insert; and a cap threaded onto the actuator insert a nozzle framework, positioned within the actuator insert, adjacent to a spray passage defined within the actuator insert, comprises:

a base of the nozzle framework defining:

an O-ring notch on an outside perimeter of the base;

a swirl chamber on an inside surface of the base;

four swirl inlets arrayed in ninety degree intervals about the swirl chamber;

a discharge passage having a first end adjacent to the swirl chamber; and a discharge aperture, defined at a second end of the swirl chamber;

a nozzle insert, positioned adjacent to the inside surface of the base of the nozzle framework, defines a center inlet adjacent to the swirl chamber and additionally defines four feed ports distributed about the center inlet at ninety degree intervals, whereby each feed port is aligned with one of the four swirl inlets defined in the base of the nozzle framework;

a spool, positioned within the coil housing, comprises a cylindrical body defining a plunger travel path and upper and lower end plates, each end plate comprising spokes between which are defined notches which allow fluid to circulate against windings wrapped about the cylindrical body of the spool;

a plunger, positioned within the plunger travel path within a magnetic field from the windings, comprises a cylindrical body having a first end within the plunger travel path and a second end supporting a plunger end plate comprising three spokes, the second end defining a lower axial channel;

pintle, positioned by the plunger, for moving between a first position wherein a head of the pintle blocks the discharge passage of the nozzle framework and a second position wherein the pintle is withdrawn from the swirl chamber, thereby allowing the passage of fluid; and a spring positioned between the spool and the plunger end plate, urges the pintle to block the discharge passage.

2. The actuated atomizer of claim 1, further comprising:

a stop, positioned within the plunger travel path, contacts the first end of the plunger when the plunger is fully withdrawn.

3. The actuated atomizer of claim 2, wherein the nozzle framework additionally comprises:

a cylindrical sidewall comprising four sections separated by four gaps, each section having an upper rim defining a first groove.

4. The actuated atomizer of claim 3, further comprising:

a coil housing positioned within an interior compartment defined within the actuator insert and cap, comprises a hollow cylindrical sidewall having a lower rim defining a second groove mated to the first groove defined in the upper rim of the nozzle framework.

5. The actuated atomizer of claim 4, further comprising:

an upper O-ring positioned between the cap and the actuator insert.

6. The actuated atomizer of claim 5, further comprising:

a lower O-ring positioned between the actuator insert and the nozzle framework.

7. The actuated atomizer of claim 6, wherein the outer shell additionally comprises:

an inner ring, positioned by a lower portion of the actuator insert;

an outer ring, positioned by an upper portion of the actuator insert; and whereby a fluid channel is defined between the inner ring and the actuator insert.

8. The actuated atomizer of claim 1, wherein the nozzle framework additionally comprises:

a cylindrical sidewall comprising four sections separated by four gaps, each section having an upper rim defining a first groove.

9. The actuated atomizer of claim 1, further comprising:

a coil housing, positioned within an interior compartment defined within the actuator insert and cap, comprises a hollow cylindrical sidewall having a lower rim defining a second groove mated to the first groove defined in the upper rim of the nozzle framework.

10. The actuated atomizer of claim 1, further comprising:

an upper O-ring positioned between the cap and the actuator insert.

11. The actuated atomizer of claim 1, further comprising:

a lower O-ring positioned between the actuator insert and the nozzle framework.

12. The actuated atomizer of claim 1, wherein the outer shell additionally comprises:

an inner ring, positioned by a lower portion of the actuator insert;

an outer ring, positioned by an upper portion of the actuator insert; and whereby an interior compartment is defined within the actuator insert and cap, and whereby a fluid channel is defined between the inner ring and the actuator insert.

13. An actuated atomizer as recited in claim 1, and further wherein the nozzle framework is configured for mounting adjacent an evaporative spray cooling chamber.

14. An actuated atomizer as recited in claim 1, and further wherein the nozzle framework is configured for mounting adjacent an a spray chamber of a fuel injection system for use with an internal combustion engine.

15. An actuated atomizer, comprising:

an outer shell comprising:

an actuator insert; and an inner ring positioned by a lower portion of the actuator insert;

an outer ring, positioned by an upper portion of the actuator insert;

a cap threaded onto the actuator insert whereby an interior compartment is defined within the actuator insert and cap, and whereby a fluid channel is defined between the inner ring and the actuator insert;

an upper O-ring, positioned between the cap and the actuator insert;

a nozzle framework, positioned within the actuator insert, adjacent to a spray passage defined within the actuator insert, comprises:

a cylindrical sidewall comprising four sections separated by four gaps, each section having an upper rim defining a first groove; and a base of the nozzle framework defining:

an O-ring notch on an outside perimeter of the base;

a swirl chamber on an inside surface of the base;

four swirl inlets arrayed in ninety degree intervals about the swirl chamber;

a discharge passage having a first end adjacent to the swirl chamber; and a discharge aperture defined at a second end of the swirl chamber;

a lower O-ring positioned between the actuator insert and the nozzle framework, forms a fluid tight seal;

a nozzle insert, positioned adjacent to the inside surface of the base of the nozzle framework, defines a center inlet adjacent to the swirl chamber and additionally defines four feed ports distributed about the center inlet at ninety degree intervals whereby each feed port is aligned with one of the four swirl inlets defined in the base of the nozzle framework;

a coil housing, positioned within the interior compartment defined within the actuator insert and cap, comprises a hollow cylindrical sidewall having a lower rim defining a second groove mated to the first groove defined in the upper rim of the nozzle framework;

a spool, positioned within the coil housing, comprises a cylindrical body defining a plunger travel path and upper and lower end plates, each end plate comprising spokes between which are defined notches which allow fluid to circulate against windings wrapped about the cylindrical body of the spool;

a plunger moves within the plunger travel path in response to a magnetic field from the windings and comprises a cylindrical body having a first end within the plunger travel path and a second end supporting a plunger end plate comprising three spokes, the second end defining a lower axial channel;

a stop, positioned within the plunger travel path, contacts the first end of the plunger when the plunger is fully withdrawn;

pintle, positioned by the plunger, for moving between a first position wherein a head of the pintle blocks the discharge passage of the nozzle framework and a second position wherein the pintle is withdrawn from the swirl chamber, allowing the passage of fluid; and a spring, positioned between the spool and the plunger end plate, urges the pintle to block the swirl chamber.

* * * * *